US005589238A

United States Patent [19]

Ruff

[11] Patent Number: 5,589,238

[45] Date of Patent: Dec. 31, 1996

[54] DECORATIVE GARLAND

[75] Inventor: Edward Ruff, Boca Raton, Fla.

[73] Assignee: Santa's Best, Northfield, Ill.

[21] Appl. No.: 535,946

[22] Filed: Sep. 28, 1995

[51] Int. Cl.[6] ..... A41G 1/04

[52] U.S. Cl. ..... 428/10; 57/24; 493/958

[58] Field of Search ..... 428/10, 7; 57/24; 156/148; 362/122; 493/958

[56] References Cited

U.S. PATENT DOCUMENTS 2,228,441 1/1941 Cohen ..... 428/10 X 2,984,036 5/1961 Adler, Jr. ..... 428/10 X 5,091,226 2/1992 Protz, Jr. ..... 428/10

5,201,699 4/1993 Protz, Jr. ..... 428/10 X

*Primary Examiner*—Henry F. Epstein

*Attorney, Agent, or Firm*—Emrich & Dithmar

[57] ABSTRACT

A garland comprising an elongated base ribbon and a plurality of annealed metal wires spirally wrapped around the base ribbon member forming a garland having substantially no spring back characteristics. The garland may include an elongated web film having a plurality of transverse cuts along both longitudinal edges arranged to form a plurality of loops with the annealed metal wire spirally wrapped around the elongated web film loops forming a garland with helically rotated loops about the wires.

14 Claims, 1 Drawing Sheet

DECORATIVE GARLAND

BACKGROUND OF THE INVENTION

The present invention is directed generally to a decorative garland. More particularly, the invention is directed to a decorative garland which may be constructed from a cut film web using a plurality of wires which are twisted around the web to form the garland. The wires are fully annealed thereby rendering them "dead" which in the context of this invention means that the garland has no memory or spring back characteristics, such that the garland when twisted to a particular position will stay in that position.

Garlands of the general type disclosed herein are illustrated in U.S. Pat. No. 5,091,226 issued Feb. 25, 1992 to Protz, Jr. and U.S. Pat. No. 5,201,699 issued Apr. 13, 1993 also issued to Protz, Jr., the disclosures of which are herein incorporated by reference.

SUMMARY OF THE INVENTION

It is therefore an object of the invention to provide an improved decorative garland.

It is another object of the invention to provide an improved decorative garland constructed from a cut film web wherein the garland may be placed in a specific geometric position supported by the wires forming a spine of the garland.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
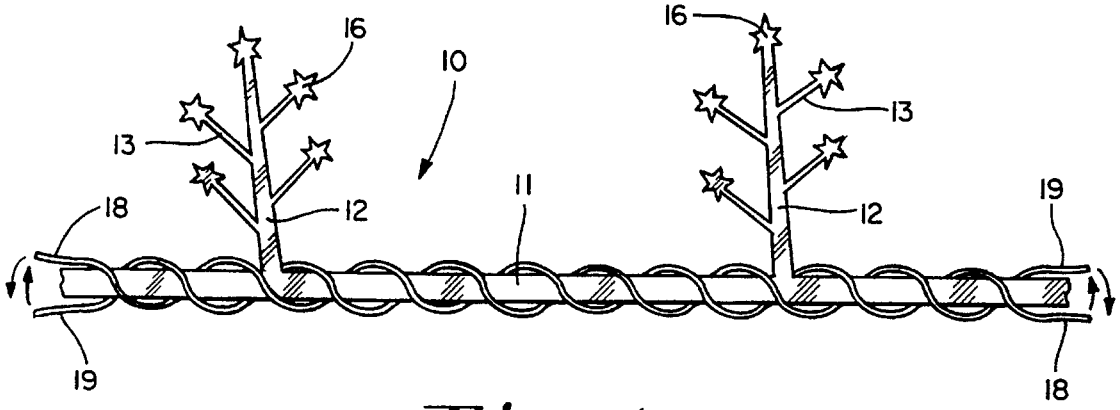
FIG. 1 is a side elevational view of an embodiment of the garland incorporating the novel aspects of the invention showing the plurality of metal wires prior to twisting.
Figure 2:
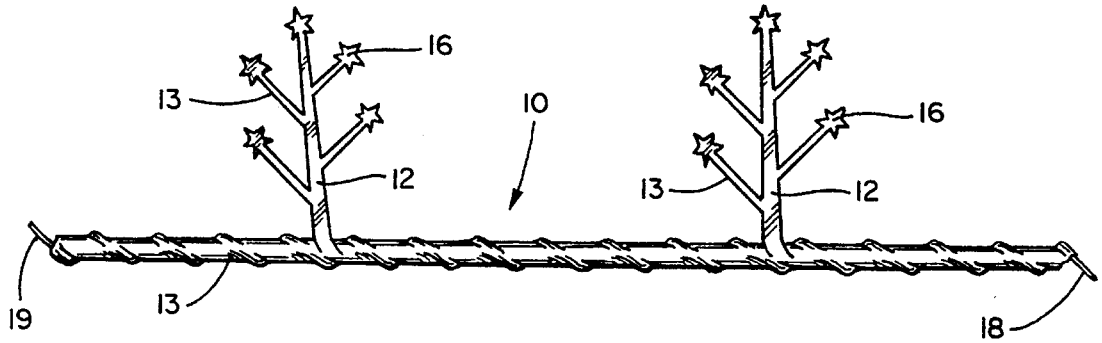
FIG. 2 is a view like FIG. 1 wherein the film is twisted about the metal wires.
Figure 3:
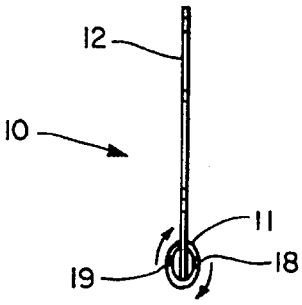
FIG. 3 is transverse cross section of the garland illustrated in FIG. 2.

Referring now to FIGS. 1–3 of the drawings, there is disclosed garland 10 comprised of an elongated ribbon 11 having opposed longitudinal side edges and a plurality of spaced apart decorative members 12 extending generally perpendicularly from the longitudinal axis of the ribbon 11. A plurality of fingers 13 extend outwardly from each of the decorative members 12 forming acute angles with the longitudinal axis of the decorative members which are generally perpendicular to the longitudinal axis of the ribbon 11. A plurality of decorative symbols are associated with each decorations 16 or symbols are associated with each of the decorative members 12. More specifically, in the example illustrated, each of the fingers 13 carries at the distal end thereof a decorative 16. Also as illustrated, each of the decorations is in the form of a star but it should be understood that the decorations which may or may not be positioned at the distal end of each and every finger 13 may be in any form desired and the invention is not limited to the use of stars.

Two wires 18 and 19 are spirally positioned around the ribbon 11 as illustrated in FIG. 1 and after a twisting of the wire occurs, the ribbon 11 wraps itself around the wires 18 and 19 forming a construction as illustrated in FIG. 2.

Figure 4:
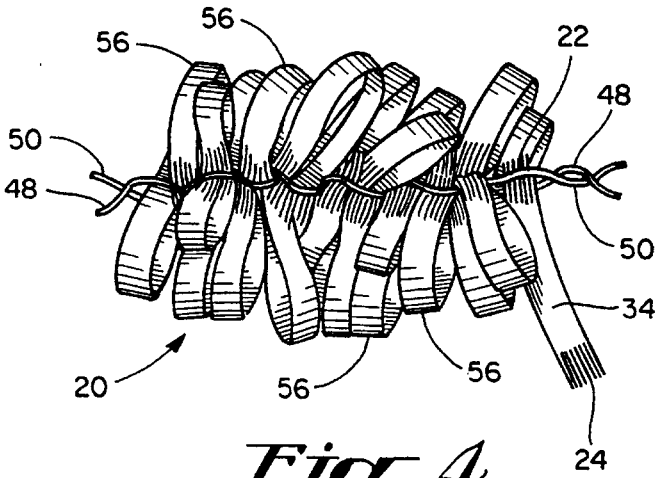
FIG. 4 is a view of another embodiment of the invention showing loops of film arranged transversely of the metal wires.

Referring to FIG. 4, there is disclosed a decorative garland which includes a web 34 which has the longitudinally extending edge portions thereof cut into strips 22 and 24 on each longitudinal edge of the web or film 34. The film 34 is formed into a plurality of transversely extending loops 56 and a pair of wires 48 and 50 are twisted around the loops 56 so as to form a spine trapping the loops 56 therebetween and forming a decorative garland 20.

Each of the garlands illustrated and described herein includes a pair of steel wires which are fully annealed and which preferably have a diameter of not less than about 0.025 inches although thicker wire may be used. The significant advantage of using fully annealed steel wires of the aforementioned thickness is that the garland may be twisted and formed into any particular position and the garland will stay in that position without any spring back characteristics which are usually encountered in garlands heretofore produced. Moreover, after a garland is put in one position, it may be changed and put into another position, again without reverting to the first position. This is a significant advantage in the use of garlands at Christmas time with decorating trees, hearths, mantles and other areas in and about the home where Christmas decorations of the type hereinbefore described are used.

While there has been disclosed what is considered to be the preferred embodiment of the present invention, it is understood that various changes in the details may be made without departing from the spirit, or sacrificing any of the advantages of the present invention.

I claim:

1. A garland comprising an elongated base ribbon and a plurality of annealed metal wires spirally wrapped around said base ribbon member forming a garland without spring back characteristics.

2. The garland of claim 1, wherein the wires are fully annealed steel.

3. The garland of claim 2, wherein the wires have a diameter of not less than about 0.025 inches.

4. The garland of claim 2, wherein said base ribbon has spaced apart decorative members extending substantially transverse to the elongated ribbon member.

5. The garland of claim 4, wherein said decorative members have a plurality of fingers extending at acute angles from said decorative members.

6. The garland of claim 5, wherein at least some of said decorative members and at least some of said fingers have decorative symbols at the ends thereof.

7. The garland of claim 6, wherein said decorative symbols are stars.

8. The garland of claim 1, wherein said elongated base ribbon is nylon.

9. The garland of claim 1, wherein said base ribbon member is wrapped around said wires.

10. The garland of claim 1, wherein said base ribbon has a plurality of transverse cuts therein forming a plurality of transversely extending decorative members.

11. A garland comprising an elongated web film having a plurality of transverse cuts along both longitudinal edges arranged to form a plurality of loops, and fully annealed dead metal wire spirally wrapped around said elongated web film loops forming a garland with helically rotated loops about said wires without spring back characteristics.

12. The garland of claim 11, wherein the wires have a diameter of not less than 0.025 inches.

13. The garland of claim 12, wherein said film is nylon.

14. The garland of claim 12, wherein said wires are at least two strands of intertwined lengths of wire.

* * * * *

UNITED STATES PATENT AND TRADEMARK OFFICE

CERTIFICATE OF CORRECTION

PATENT NO. : 5,589,238

DATED : December 31, 1996

INVENTOR(S) : Edward Ruff

It is certified that error appears in the above-identified patent and that said Letters Patent is hereby corrected as shown below:

Claim 1, line 2, after the word "annealed" insert --dead--.

Signed and Sealed this

Eighteenth Day of March, 1997

*Attest:*

Bruce Lehman

BRUCE LEHMAN

*Attesting Officer*

*Commissioner of Patents and Trademarks*